US007207282B1

(12) United States Patent
Ruan et al.

(10) Patent No.: US 7,207,282 B1
(45) Date of Patent: Apr. 24, 2007

(54) PROPELLER DRIVEN SURFING DEVICE

(75) Inventors: Chia-Wen Ruan, Nantou (TW); Ming-Chen Liao, Nantou (TW)

(73) Assignee: Joy Ride Tech. Co., Ltd., Nantou (TW)

( * ) Notice: Subject to any disclaimer, the term of this patent is extended or adjusted under 35 U.S.C. 154(b) by 0 days.

(21) Appl. No.: 11/342,017

(22) Filed: Jan. 27, 2006

(30) Foreign Application Priority Data

Oct. 21, 2005 (TW) ..... 94136886 A

(51) Int. Cl.
*B63B 35/73* (2006.01)

(52) U.S. Cl. ..... 114/55.56; 441/74

(58) Field of Classification Search ..... None
See application file for complete search history.

(56) References Cited

U.S. PATENT DOCUMENTS 3,324,822 A * 6/1967 Carter, III ..... 114/55.56
4,971,586 A * 11/1990 Walsh ..... 114/55.56
5,105,753 A * 4/1992 Chih et al. ..... 114/315
5,568,783 A * 10/1996 Ditchfield ..... 114/315
6,192,817 B1 * 2/2001 Dec et al. ..... 114/55.56
6,568,340 B2 * 5/2003 Dec et al. ..... 114/55.56

* cited by examiner

*Primary Examiner*—Lars A. Olson
(74) *Attorney, Agent, or Firm*—Brooks Kushman P.C.

(57) ABSTRACT

A propeller driven surfing device includes an elongated body defining an accommodation chamber for receiving a drive motor and a power supply therein. A propeller is driven by the drive motor, and is disposed outwardly and rearwardly of the elongated body. A shell member includes a front surrounding segment which surrounds and which is spaced apart from the elongated body to define a passageway therebetween, and a rear surrounding segment which extends rearwardly to terminate at a distal end that is disposed rearwardly of the propeller. The front surrounding segment and the distal end respectively define a water intake port and a water outlet port which are disposed upstream and downstream of the passageway, respectively, such that water flows from the intake port and out of the outlet port through the passageway.

12 Claims, 14 Drawing Sheets

PROPELLER DRIVEN SURFING DEVICE

CROSS-REFERENCE TO RELATED APPLICATION

This application claims priority of Taiwanese Application No. 094136886, filed on Oct. 21, 2005.

BACKGROUND OF THE INVENTION

1. Field of the Invention

This invention relates to a surfing device, more particularly to a propeller driven surfing device driven by a motor for propelling through water.

2. Description of the Related Art

Referring to FIGS. 1 and 2, a conventional water propeller device 100 can be used in a diving activity (as shown in FIG. 1), and can be connected to a float board 101 for use in swimming (as shown in FIG. 2). However, the user has to hold the device 100 with both hands, which is inconvenient.

Referring to FIGS. 3 and 4, a conventional propeller driven surfing device is shown to include a float board 11, a propeller unit 12 disposed on the surfboard 11, and a control handle 13 coupled to the propeller unit 12. The surfboard 11 has front and back edges 111, 112, and top and bottom surfaces 113,114 interconnecting the front and back edges 111,112. The propeller unit 12 is connected to the back edge 112 by a dovetailed joint 122 and is operable to generate a driving force to propel the surfboard 11 forward. The propeller unit 12 includes a body 121, a drive motor (not shown) which is disposed in the body 121 and which has an output shaft 124 extending rearwardly, and a propeller 125 which is coupled to the output shaft 124 and which is covered with a meshed guard. The control handle 13 includes a handlebar 131 connected to and extending from the propeller unit 12, and a handgrip 132 attached to an upper end of the handlebar 131 to be used for steadying the user and for actuating the drive motor.

Although this propeller driven surfing device allows a person with little surfboard riding skill to operate in relatively calm water, the following drawbacks arise:

1. Since the propeller unit 12 and the control handle 13 are disposed at the back edge 112 of the surfboard 11, the weight of the surfboard 11 is centered at the back edge 112 so that the surfboard 11 is inclined rearwardly. Thus, the surf riding routines is difficult to perform.

2. Due to the design of the propeller 125, water currents generated as a result of operation of the propeller 125 are divided with small jets so that the propelling force is not sufficient. Besides, the meshed guard covering the propeller 125 may thwart the flow of the water, thereby further weakening the propelling force of the water.

3. Since the control handle 13 is fixed to the propeller unit 12, when the user stands on the surfboard 11 and grips the handgrip 132, he/she cannot freely change his/her standing posture. Besides, as shown in FIG. 5, the user cannot operate the control handle 13 when lying prostrate on the surfboard 11. Thus, the freedom and pleasure of surfing are discounted.

SUMMARY OF THE INVENTION

The object of the present invention is to provide a propeller driven surfing device which can achieve a great driving force for forward propulsion.

Another object of the present invention is to provide a propeller driven surfing device which allows the user to perform surfing with a greater flexibility and freedom.

According to this invention, the propeller driven surfing device includes an elongated body, a drive unit, a shell member, and an operating unit. The elongated body has front and rear ends opposite to each other along a longitudinal axis, and a tubular wall extending in a longitudinal direction parallel to the longitudinal axis to interconnect the front and rear ends so as to define an accommodation chamber therein. The drive unit includes a drive motor, a power supply, and a control member disposed in the accommodation chamber. The control member is electrically coupled to the drive motor and the power supply. A propeller is driven by the drive motor, and is disposed outwardly of the elongated body and rearwardly of the rear end. The shell member includes a front surrounding segment which surrounds and which is spaced apart from the tubular wall to define a passageway therebetween, and a rear surrounding segment which extends rearwardly from the front surrounding segment in the longitudinal direction and which terminates at a distal end that is disposed rearwardly of the propeller. The front surrounding segment and the distal end respectively define a water intake port and a water outlet port which are disposed upstream and downstream of the passageway, respectively, such that water flows from the intake port and out of the outlet port through the passageway. The operating unit is electrically coupled to the control member, and is disposed to be movable relative to the shell member so as to be operable to control operation of the control member.

BRIEF DESCRIPTION OF THE DRAWINGS

Other features and advantages of the present invention will become apparent in the following detailed description of the preferred embodiments of the invention, with reference to the accompanying drawings, in which.

DETAILED DESCRIPTION OF THE PREFERRED EMBODIMENTS

Figure 1:
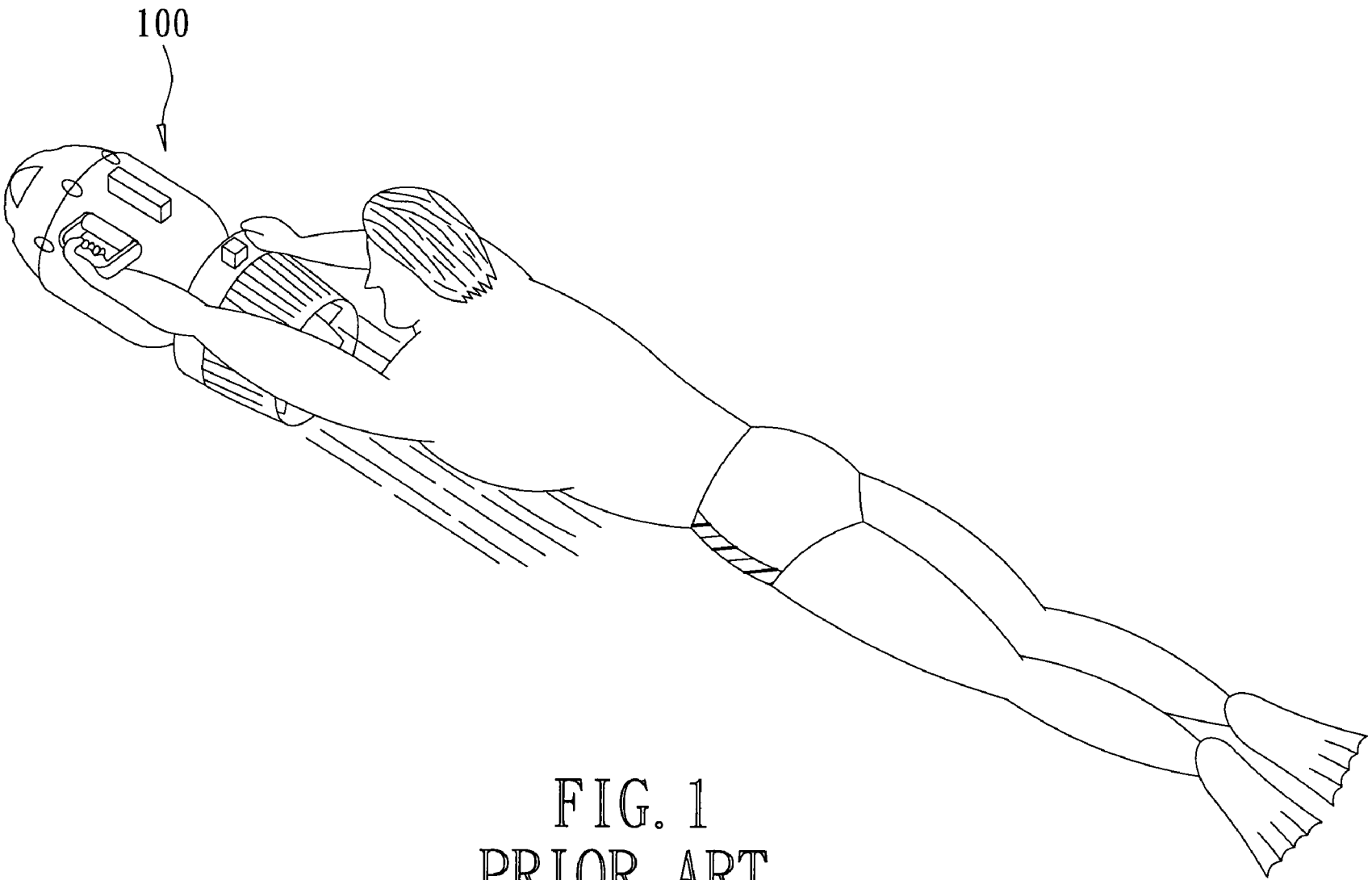
FIG. 1 PRIOR ART
FIG. 1 is a perspective view of a conventional water propeller in a state of use.
Figure 2:
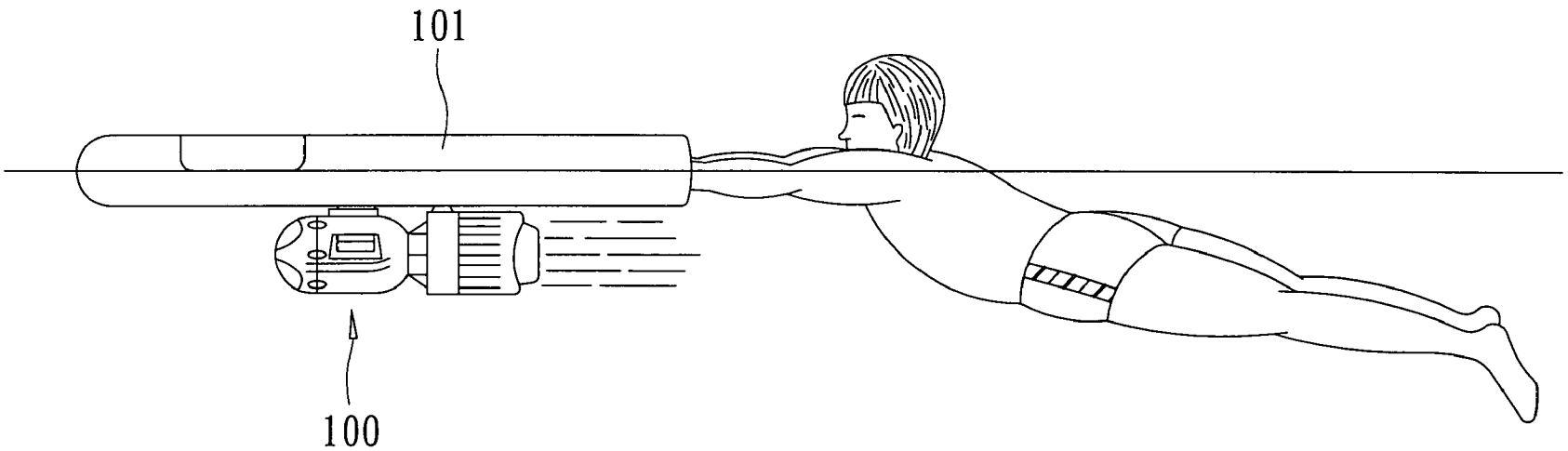
FIG. 2 PRIOR ART
FIG. 2 is a side view of the conventional water propeller of FIG. 1 in another state of use.
Figure 3:
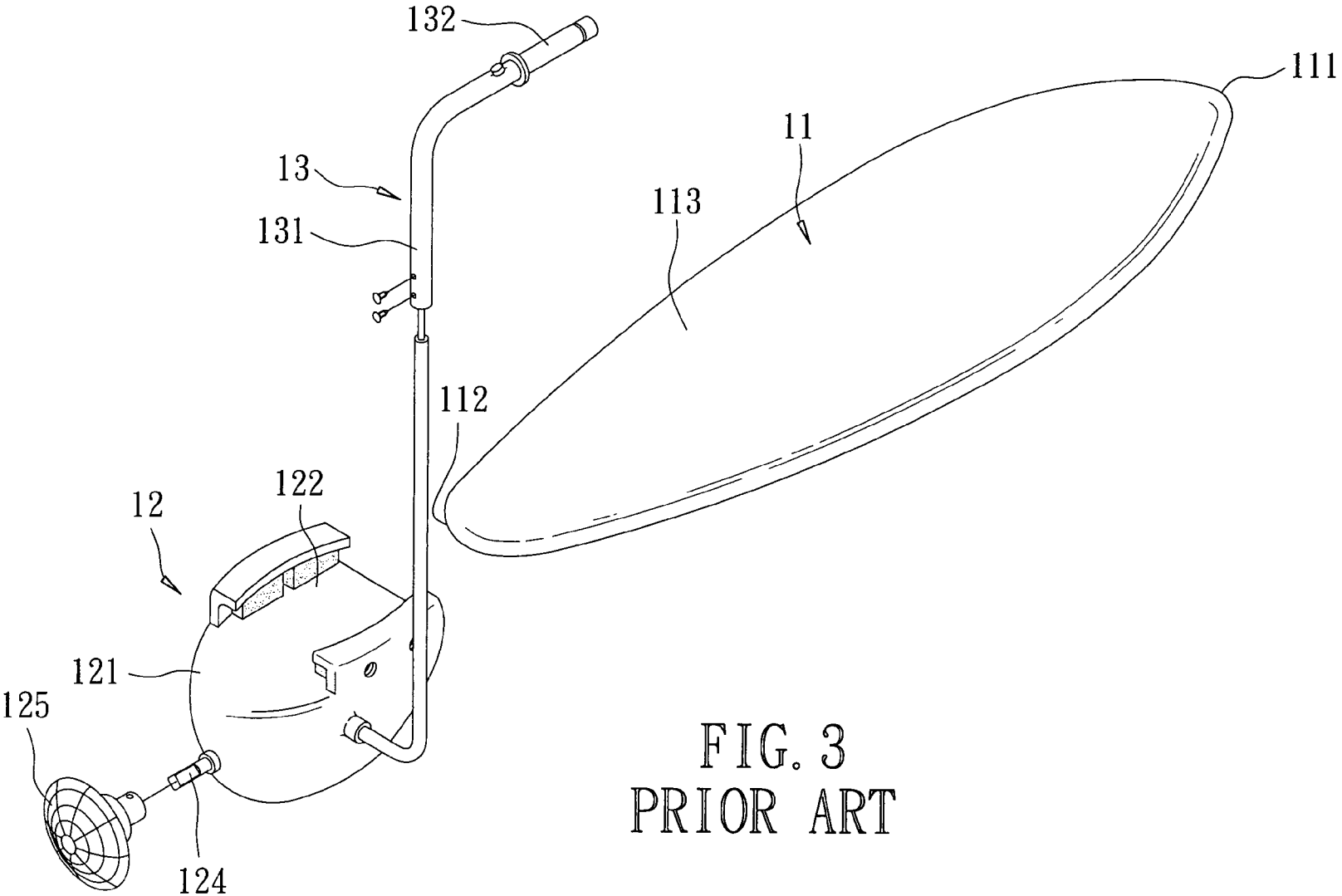
FIG. 3 PRIOR ART
FIG. 3 is an exploded perspective view of a conventional propeller driven surfing device.
Figure 4:
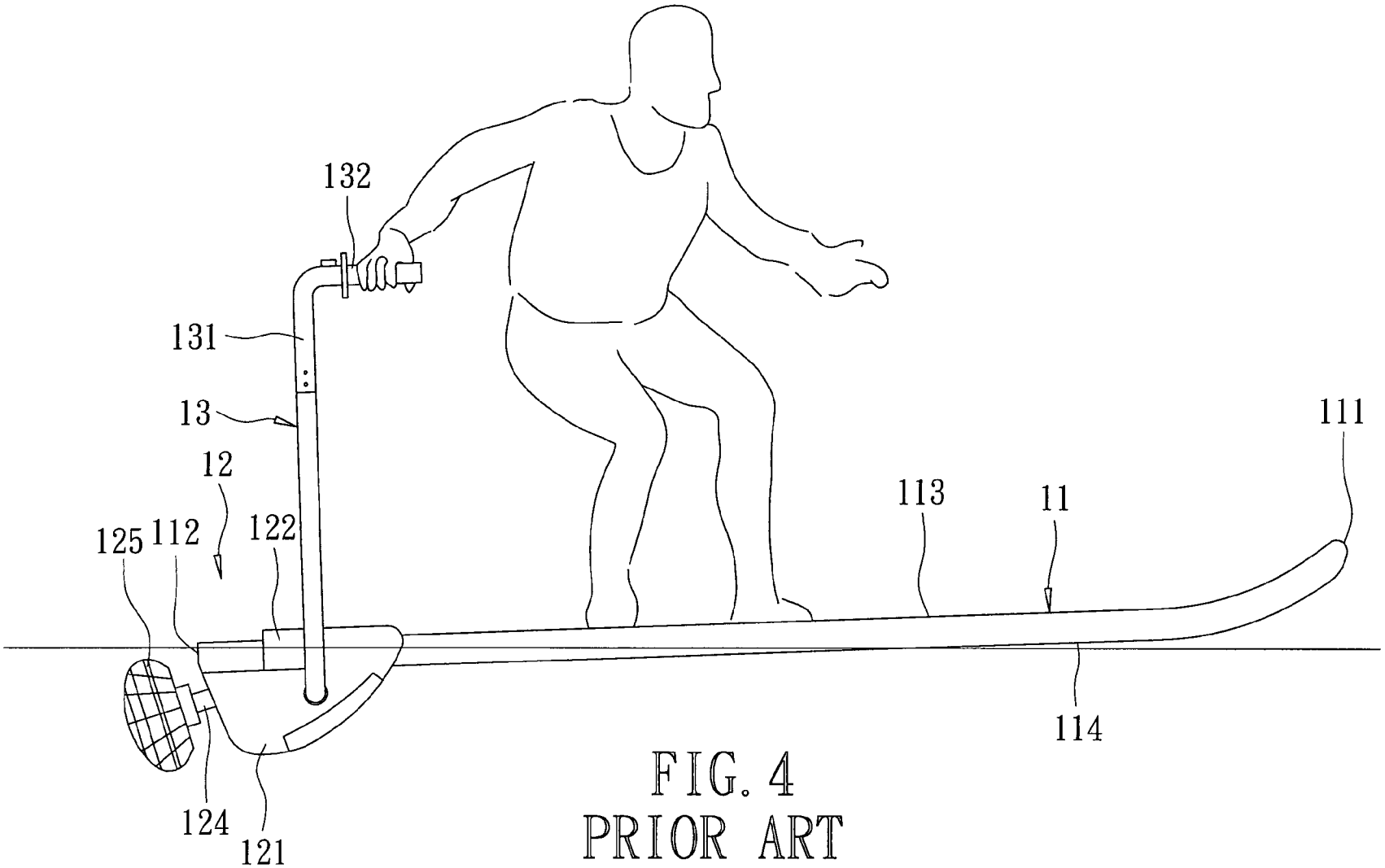
FIG. 4 PRIOR ART
FIG. 4 is a side view of the conventional propeller driven surfing device of FIG. 3 in a state of use.
Figure 5:
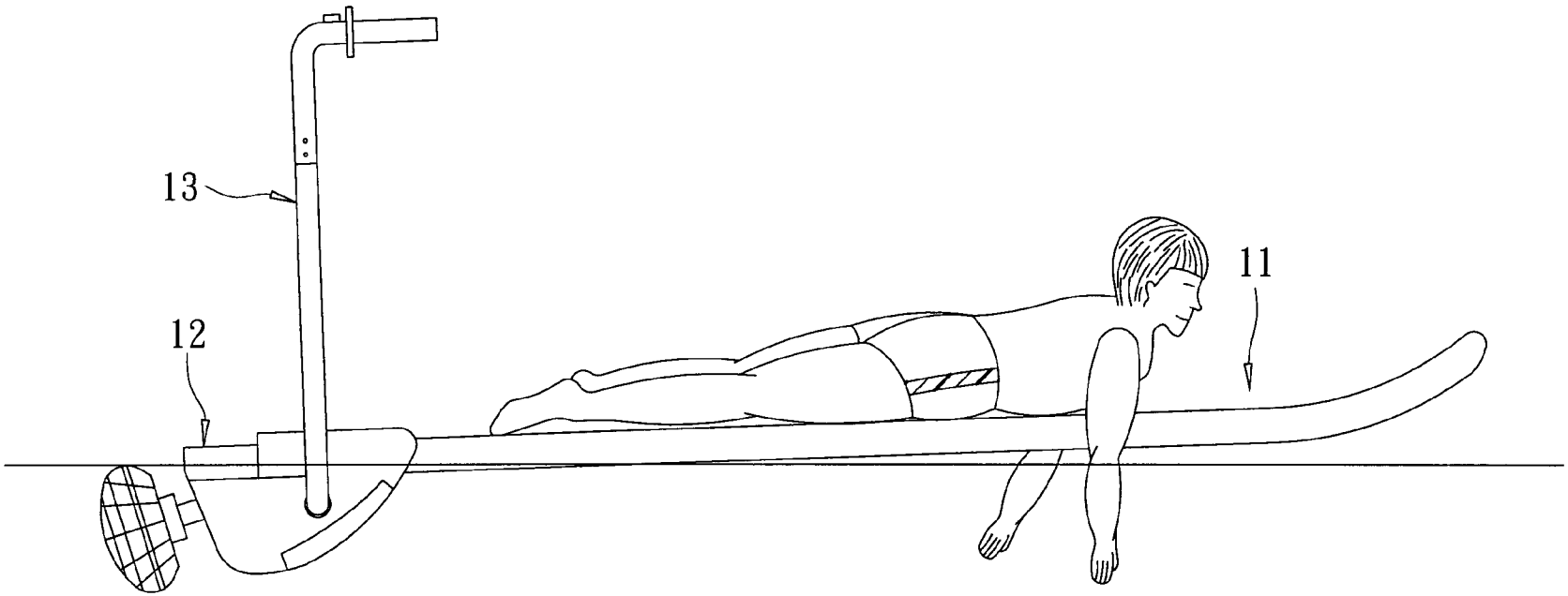
FIG. 5 PRIOR ART
FIG. 5 is a side view of the conventional propeller driven surfing device of FIG. 3 in another state of use.

Before the present invention is described in greater detail, it should be noted that same reference numerals have been used to denote like elements throughout the specification.

Figure 6:
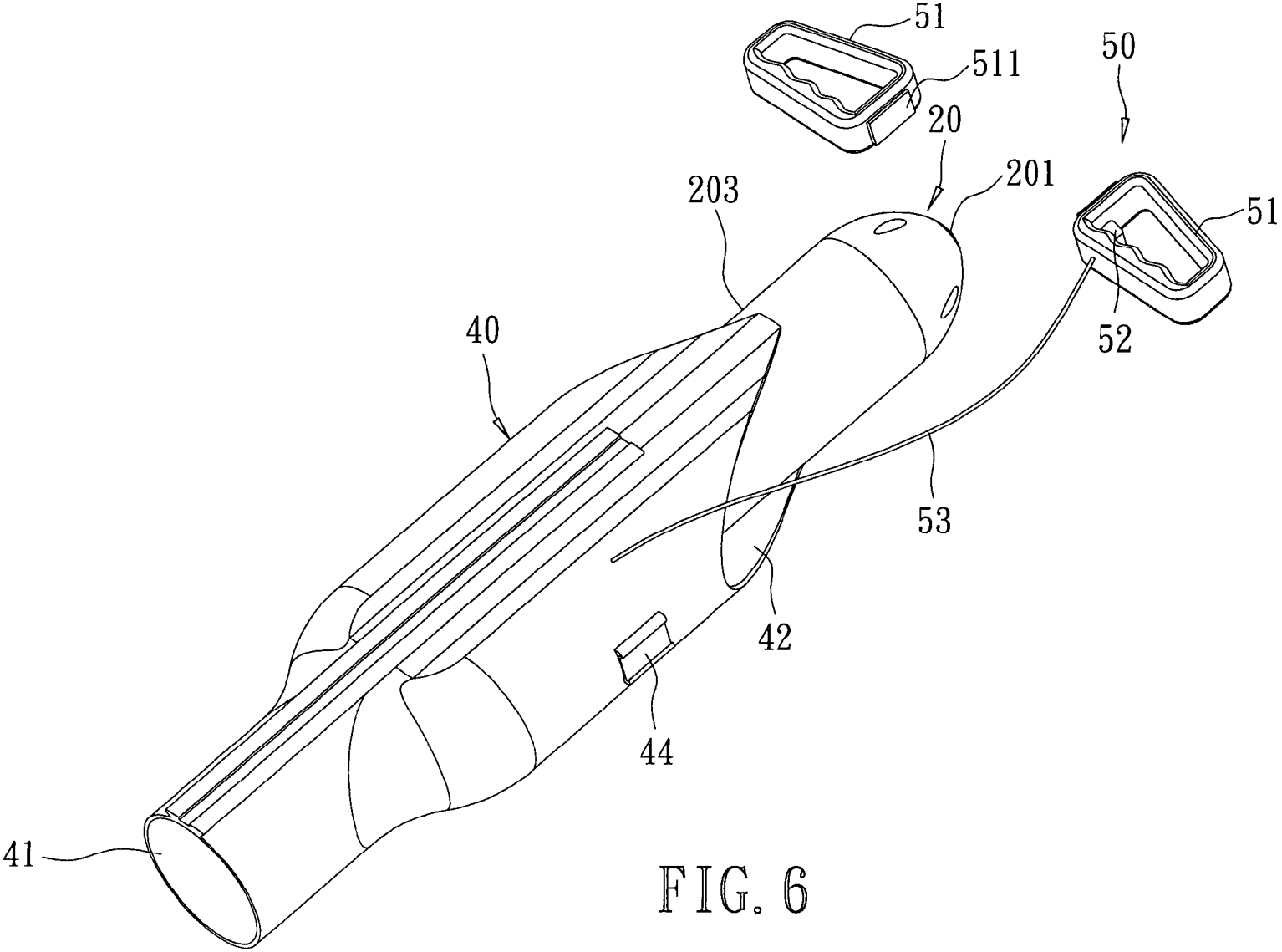
FIG. 6 is a perspective view of the first preferred embodiment of a propeller driven surfing device according to this invention.
Figure 7:
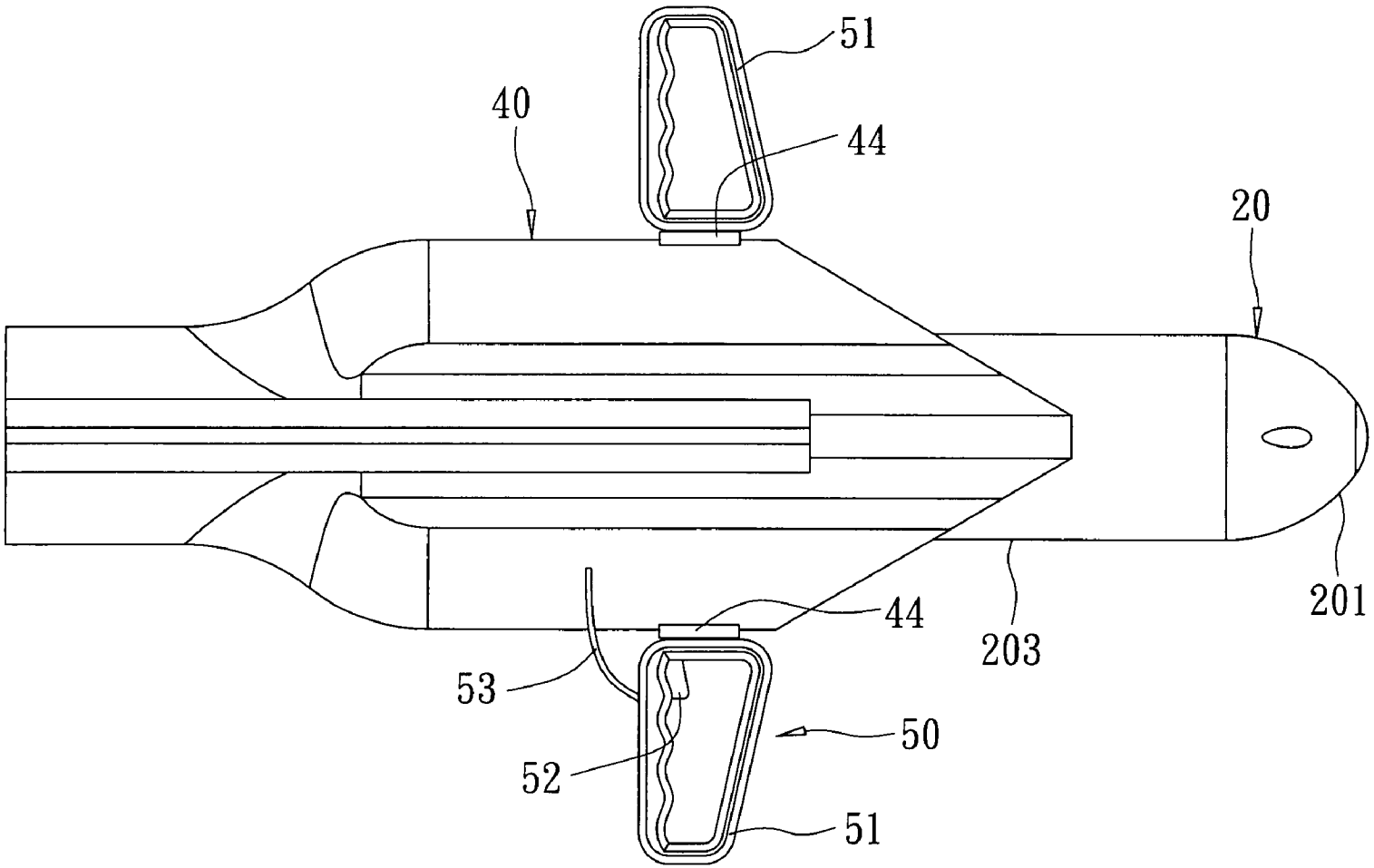
FIG. 7 is a top view of the first preferred embodiment of FIG. 6.
Figure 8:
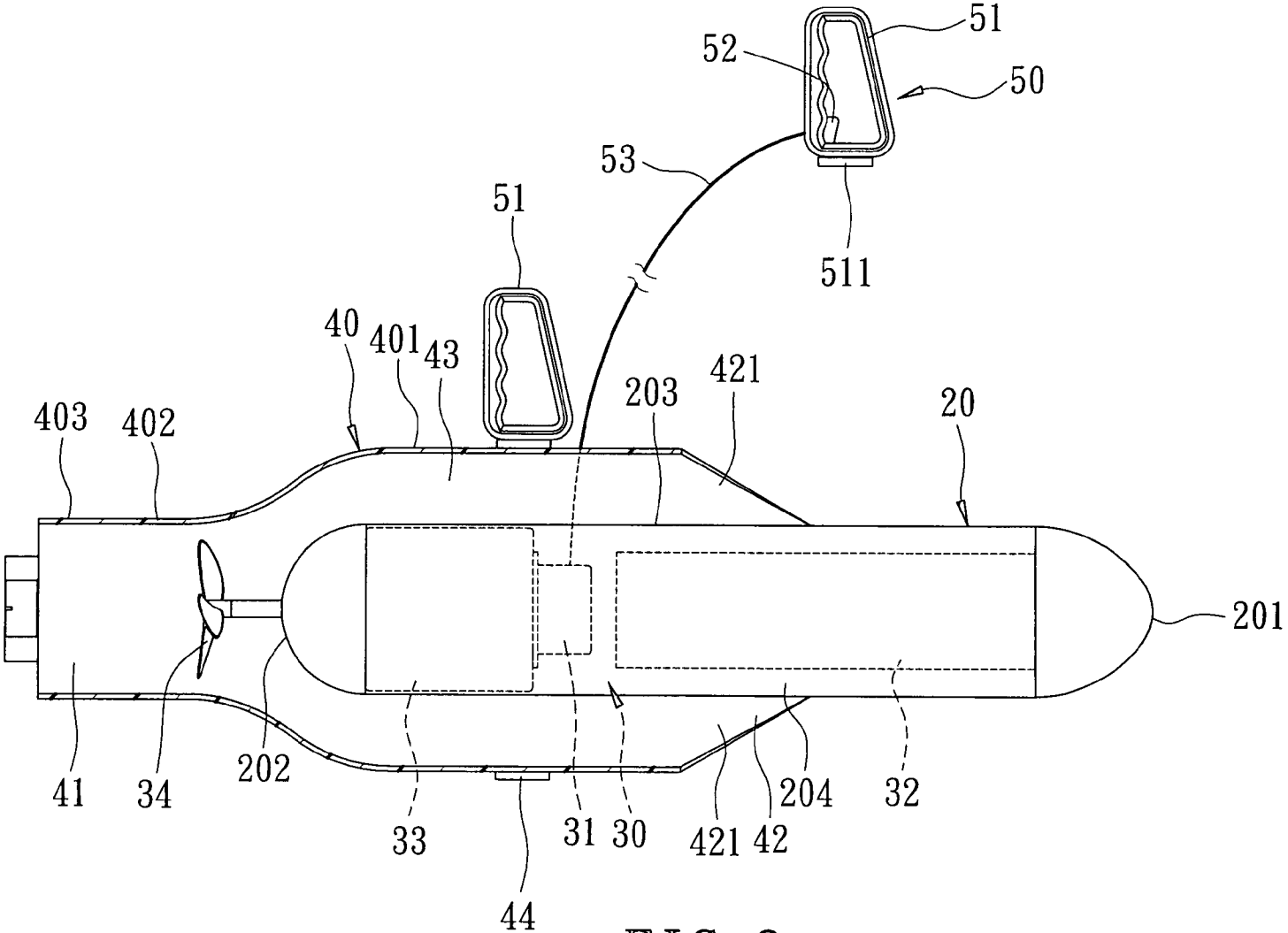
FIG. 8 is a sectional view of the first preferred embodiment of FIG. 6.

Referring to FIGS. 6 to 8, the first preferred embodiment of a propeller driven surfing device according to the present invention is shown to comprise an elongated body 20, a drive unit 30, a shell member 40, and an operating unit 50.

The elongated body 20 is torpedo-shaped, and has front and rear ends 201,202 opposite to each other along a longitudinal axis, and a tubular wall 203 extending in a longitudinal direction parallel to the longitudinal axis to interconnect the front and rear ends 201,202 so as to define an accommodation chamber 204 therein.

The drive unit 30 includes a control member 31, such as a control module which is disposed in the accommodation chamber 204, a power supply 32, such as a battery, which is disposed in the accommodation chamber 204 and which is electrically coupled to the control member 31, a drive motor 33 which is disposed in the accommodation chamber 204 and which is electrically coupled to the control member 31, and a propeller 34 which is driven by the drive motor 33 and which is disposed outwardly of the elongated body 20 and rearwardly of the rear end 202.

The shell member 40 includes a front surrounding segment 401 which surrounds and which is spaced apart from the tubular wall 203 to define a passageway 43 therebetween, and a rear surrounding segment 402 which extends rearwardly from the front surrounding segment 401 in the longitudinal direction and which terminates at a distal end 403 that is disposed rearwardly of the propeller 34 and that is spaced apart from the propeller 34 in the longitudinal direction. The rear surrounding segment 402 is configured to converge towards the longitudinal axis from the front surrounding segment 401 to the distal end 403. The front surrounding segment 401 defines a water intake port 42 having a pair of intake port portions 421 which are disposed opposite to each other in a diametrical direction relative to the longitudinal axis and which are disposed upstream of the passageway 43 such that water entering the passageway 43 through the two intake port portions 421 during operation of the propeller 34 forms two water currents in the passageway 43. The distal end 403 defines a water outlet port 41 which is disposed downstream of the passageway 43. Thus, the two water currents in the passageway 43 will meet before reaching the propeller 34 and will flow out of the outlet port 41 as one column of water. Moreover, the front surrounding segment 401 has a pair of positioning sockets 44 which are disposed diametrically opposite to each other.

The operating unit 50 includes a pair of handgrips 51, each of which has a plug 511 that is configured to be detachably fitted into a respective one of the positioning sockets 44 in a mortise-and-tenon engagement using, for instance, a dovetail structure, and a control button 52 which is mounted on one of the handgrips 51 and which is electrically coupled to the control member 31 by means of a signal cable 53. Hence, the operating unit 50 is movable and operable by the user to control operation of the control member 31 so as to shift the drive of the drive motor 33, such as the rotational speed thereof.

Accordingly, when the propeller 34 is driven and rotated, water flows from the intake port portions 421 into the passageway 43 to form two water currents along the tubular wall 203 of the elongated body 20. The two water currents subsequently meet before reaching the propeller 34, and flow out of the outlet port 41 as one column of water. By virtue of the provision of the shell member 40 and the fully opened outlet port 41, water flow is not thwarted by any interfering objects so that the drive force generated as a result of action of the propeller 34 can be fully utilized to propel the surfing device forward.

Besides, since the handgrip 51 having the control button 52 mounted thereon is detachable from the positioning socket 44, the user can operate the control button 52 to control the propeller 34 in any posture, thereby affording the user with greater flexibility and freedom when performing a water activity.

Figure 9:
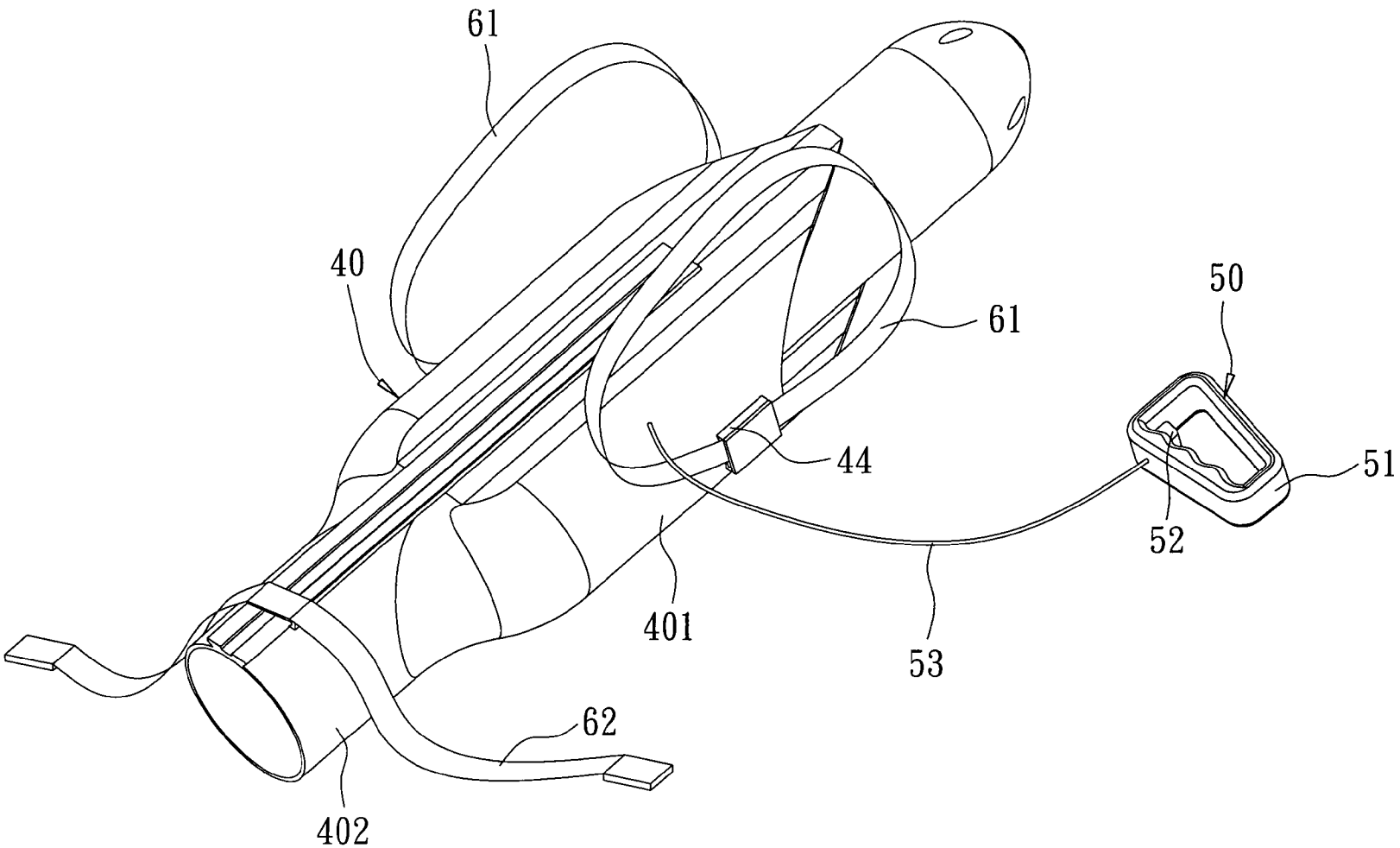
FIG. 9 is a perspective view of the second preferred embodiment of a propeller driven surfing device according to this invention.

Referring to FIG. 9, the second preferred embodiment of a propeller driven surfing device according to this invention is shown to be similar to that of the aforesaid embodiment in construction. This embodiment further includes a pair of shoulder straps 61 which are detachably mounted on the positioning sockets 44 of the front surrounding segment 401 of the shell member 40, and a waist strap 62 which is detachably mounted on the rear surrounding segment 402 of the shell member 40 by means of dovetail joints, thereby facilitating carrying of the surfing device.

Figure 10:
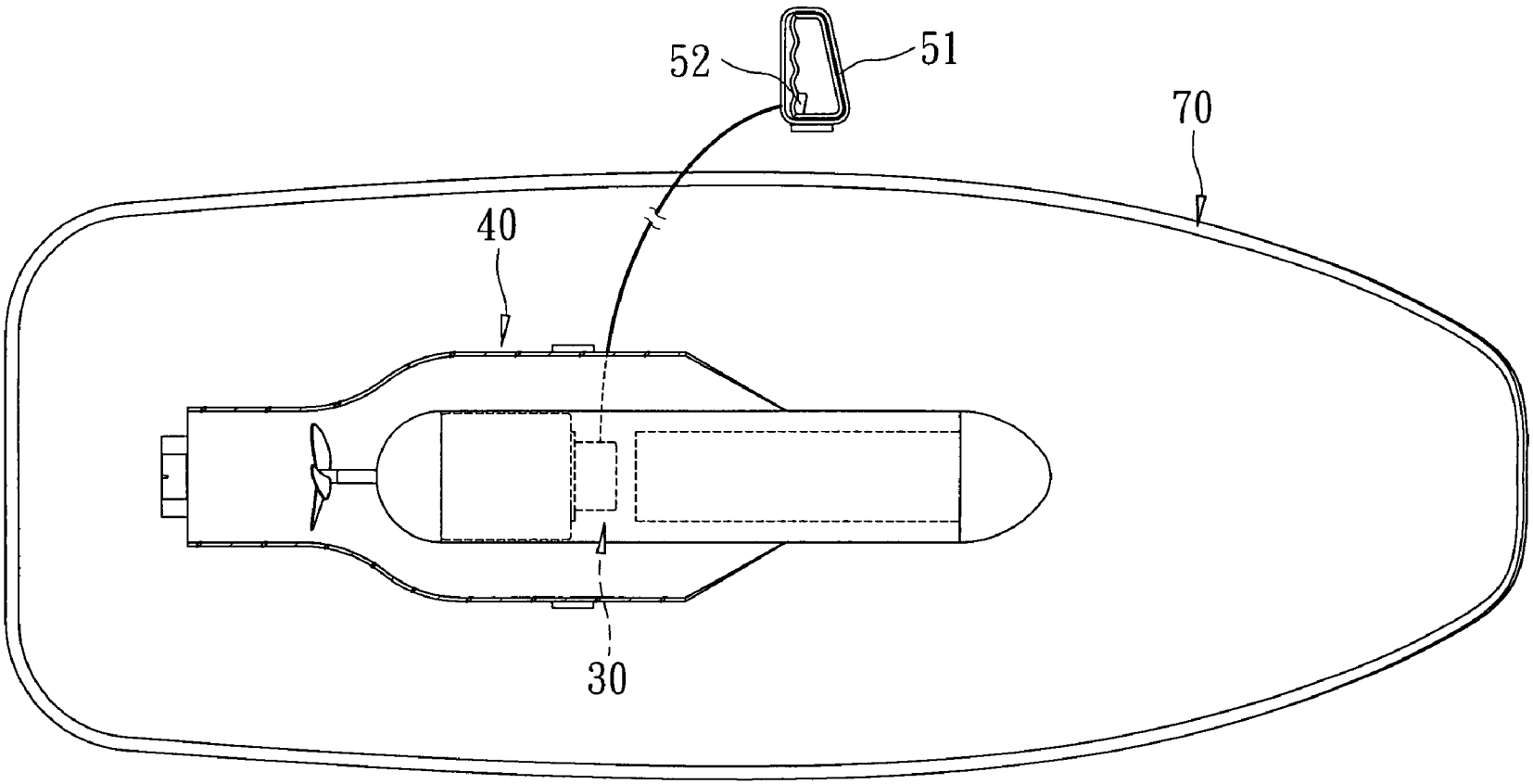
FIG. 10 is a sectional view of the third preferred embodiment of a propeller driven surfing device according to this invention.
Figure 11:
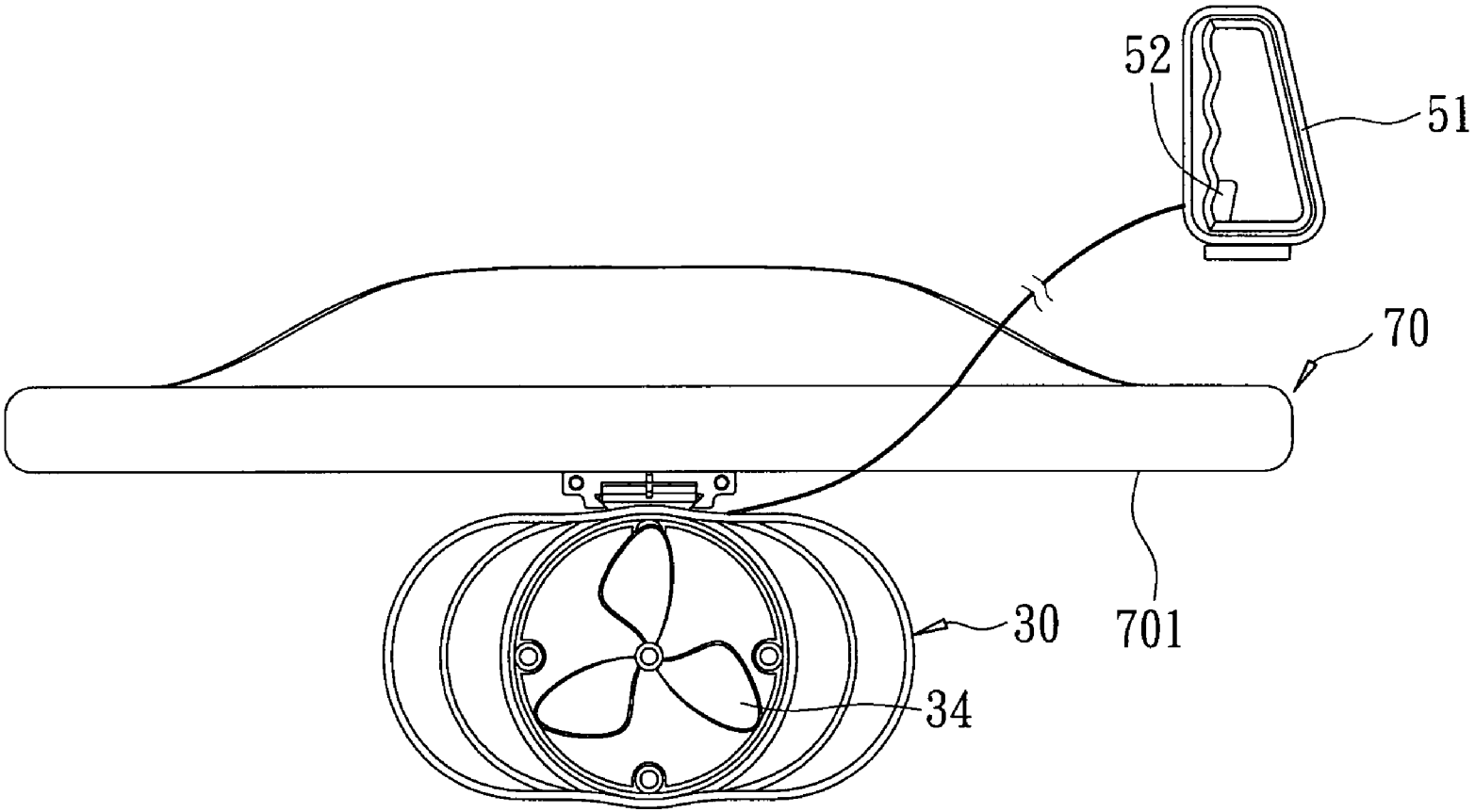
FIG. 11 is a rear view of the third preferred embodiment of FIG. 10.
Figure 12:
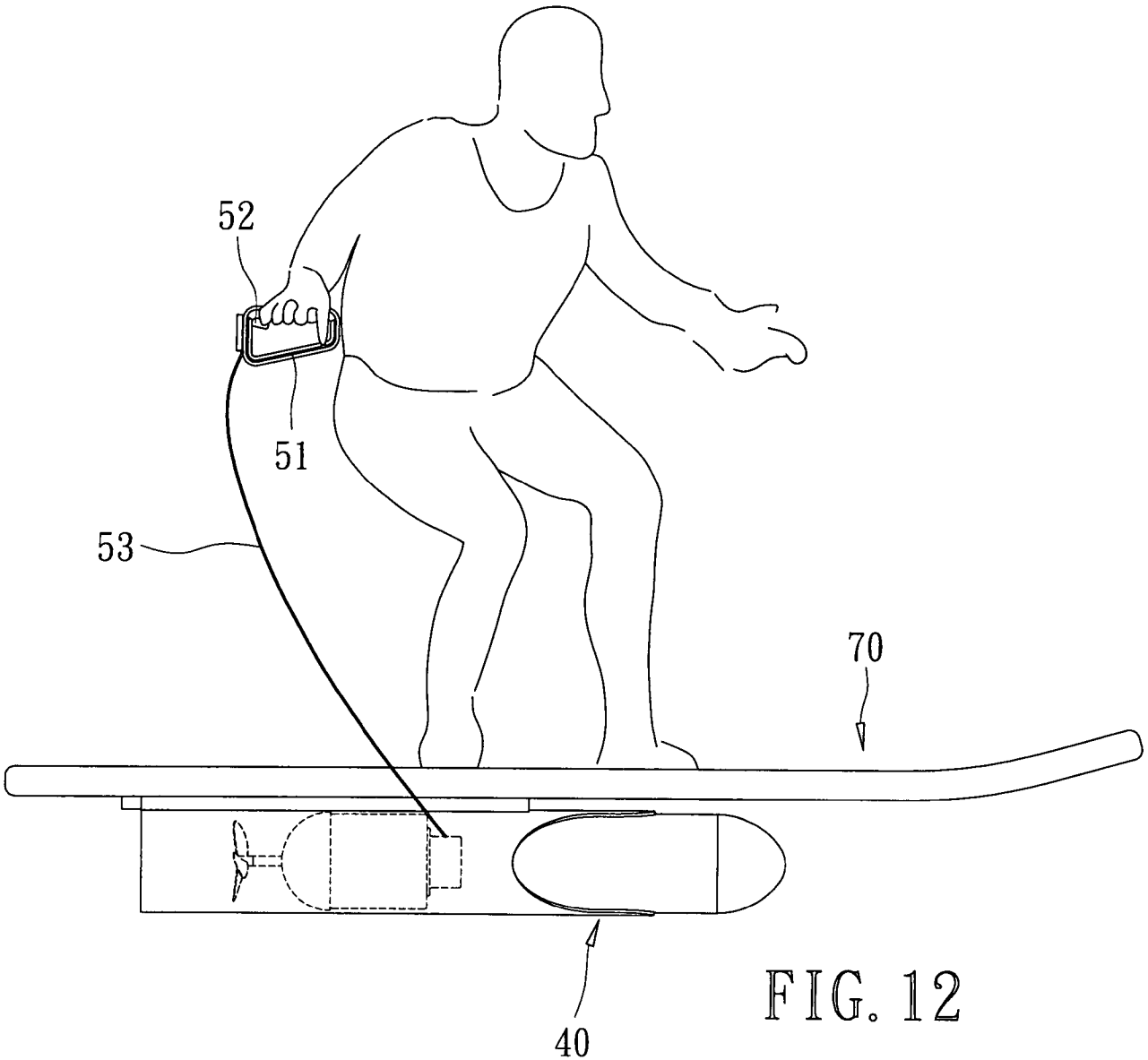
FIG. 12 is a side view of the third preferred embodiment of FIG. 10 in a state of use.

Referring to FIGS. 10 to 12, the third preferred embodiment of a propeller driven surfing device according to this invention is shown to be similar to that of the first preferred embodiment in construction. This embodiment further includes a surfboard 70 which has a bottom surface 701. The shell member 40 is detachably coupled to the bottom surface 701 in a mortise-and-tenon engagement by way of a dovetail joint, for instance. Thus, the user can stand on the surfboard 70 and grip the handgrip 51 to operate the control button 52. It is noted that as the elongated body 20, the drive unit 30 and the shell member 40 are disposed at a middle position of the surfboard 70 where the center of gravity of the surfing device is located, the user can practice surfing with greater flexibility as if using a conventional surfboard.

Figure 13:
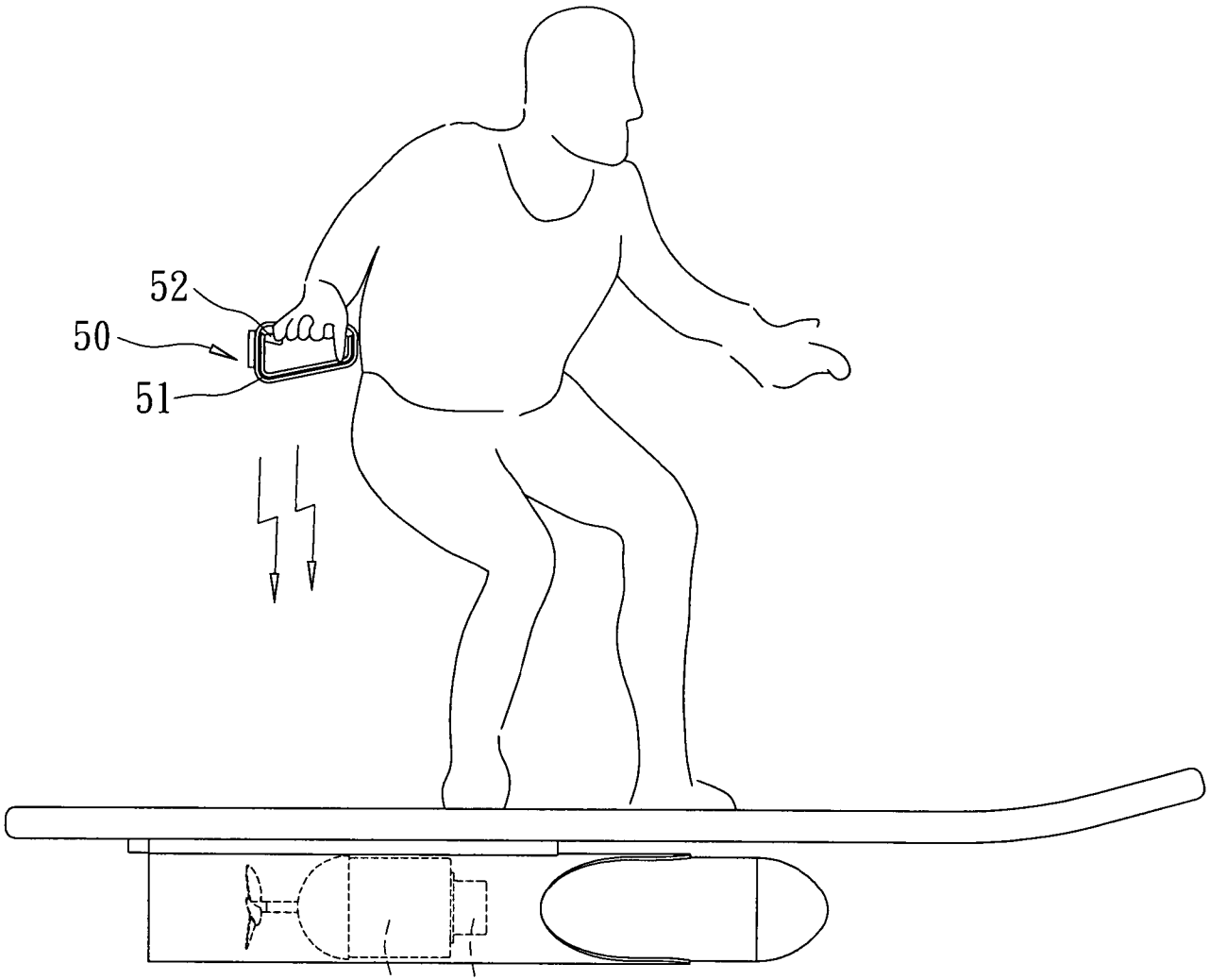
FIG. 13 is a side view of the fourth preferred embodiment of a propeller driven surfing device according to this invention.
Figure 14:
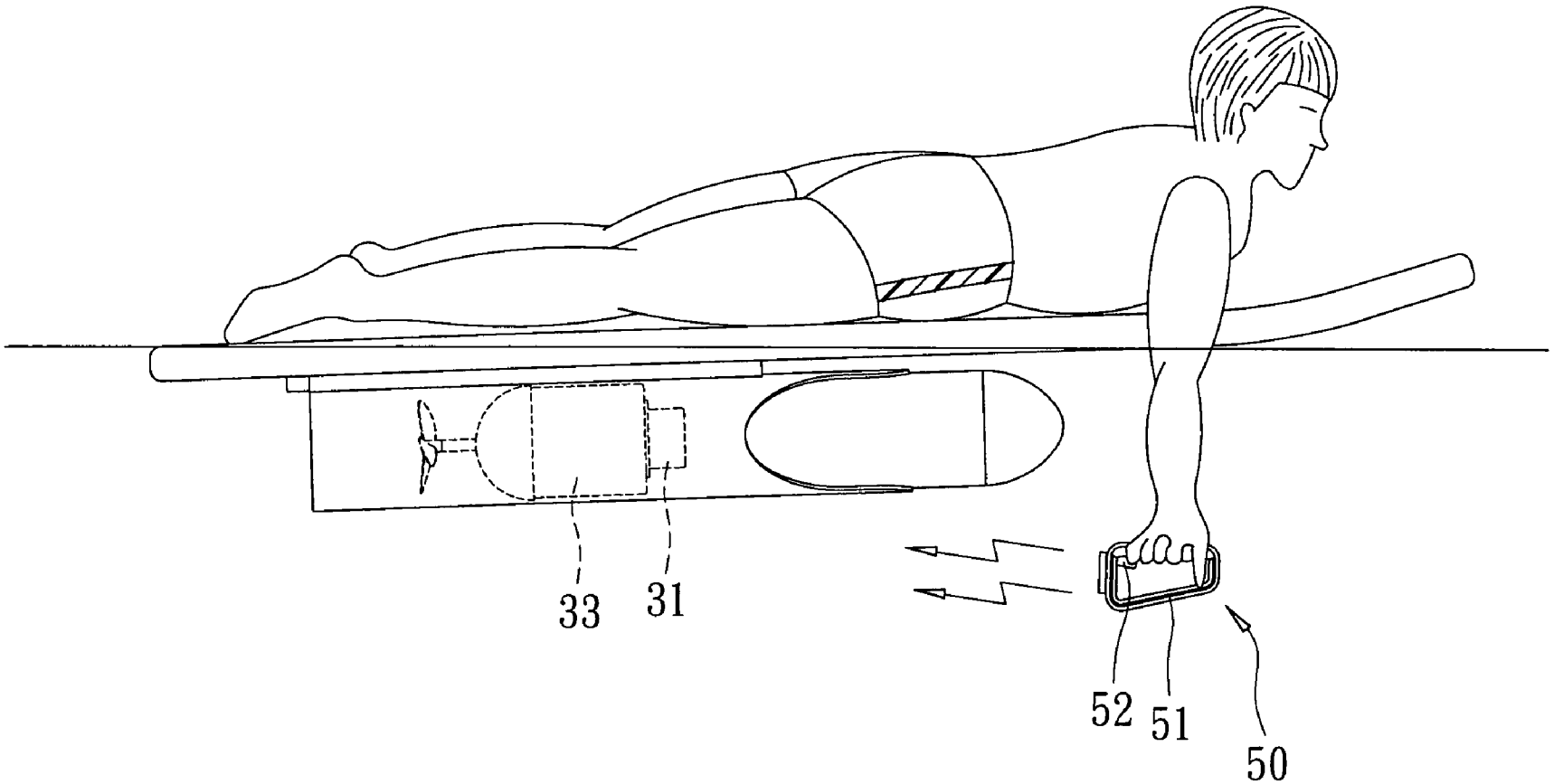
FIG. 14 is a side view of the fourth preferred embodiment of FIG. 13 in another state of use.

Referring to FIGS. 13 and 14, the fourth preferred embodiment of a propeller driven surfing device according to this invention is shown to be similar to the third preferred embodiment in construction. In this embodiment, the control member 31 includes a wireless communication module which is disposed to control the drive motor 33 in response to a signal emitted from the operating unit 50 in a known manner, thereby dispensing with the signal cable 53.

While the present invention has been described in connection with what is considered the most practical and preferred embodiments, it is understood that this invention is not limited to the disclosed embodiments but is intended to cover various arrangements included within the spirit and scope of the broadest interpretations and equivalent arrangements.

We claim:

1. A propeller driven surfing device, comprising:

an elongated body having front and rear ends opposite to each other along a longitudinal axis, and a tubular wall extending in a longitudinal direction parallel to the longitudinal axis to interconnect said front and rear ends so as to define an accommodation chamber therein;

a drive motor disposed in said accommodation chamber;

a power supply disposed in said accommodation chamber, and operationally coupled to said drive motor;

a propeller which is driven by said drive motor, and which is disposed outwardly of said elongated body and rearwardly of said rear end;

a shell member including a front surrounding segment which surrounds and which is spaced apart from said tubular wall to define a passageway therebetween, and a rear surrounding segment which extends rearwardly from said front surrounding segment in the longitudinal direction and which terminates at a distal end that is disposed rearwardly of said propeller and that is spaced apart from said propeller in the longitudinal direction, said front surrounding segment and said distal end respectively defining a water intake port and a water outlet port which are disposed upstream and downstream of said passageway, respectively, such that water flows from said intake port and out of said outlet port through said passageway; and a control member which is disposed in said accommodation chamber and which is electrically coupled to said drive motor and said power supply so as to control operation of said drive motor.

2. The propeller driven surfing device of claim 1, wherein said intake port has a pair of intake port portions which are disposed opposite to each other in a diametrical direction relative to the longitudinal axis such that water entering said passageway through said two intake port portions during action of said propeller forms two water currents in said passageway.

3. The propeller driven surfing device of claim 2, wherein said rear surrounding segment is configured to converge towards the longitudinal axis from said front surrounding segment to said distal end such that the two water currents in said passageway meet before reaching said propeller.

4. The propeller driven surfing device of claim 1, further comprising an operating unit which is electrically coupled to said control member, and which is disposed to be movable relative to said shell member so as to be operable to control operation of said control member.

5. The propeller driven surfing device of claim 4, wherein said front surrounding segment has a pair of positioning sockets which are disposed diametrically opposite to each other, said operating unit including a pair of handgrips, each of which has a plug that is configured to be detachably inserted into a respective one of said positioning sockets.

6. The propeller driven surfing device of claim 5, wherein said plug and the respective one of said sockets are configured to mate with each other in a mortise-and-tenon engagement.

7. The propeller driven surfing device of claim 5, wherein said operating unit further includes a control button which is mounted on one of said handgrips and which is electrically coupled to said control member.

8. The propeller driven surfing device of claim 4, further comprising a signal cable which is electrically connected to said operating unit and said control member.

9. The propeller driven surfing device of claim 4, wherein said control member includes a wireless communication module which is disposed to control said drive motor in response to a signal emitted from said operating unit.

10. The propeller driven surfing device of claim 1, further including a surfboard which has a bottom surface, said shell member being detachably mounted on said bottom surface.

11. The propeller driven surfing device of claim 10, wherein said bottom surface of said surfboard and said shell member are configured to mate with each other in a mortise-and-tenon engagement.

12. A propeller driven surfing device, comprising:

an elongated body having front and rear ends opposite to each other along a longitudinal axis, and a tubular wall extending in a longitudinal direction parallel to the longitudinal axis to interconnect said front and rear ends so as to define an accommodation chamber therein;

a drive motor disposed in said accommodation chamber;

a power supply disposed in said accommodation chamber, and operationally coupled to said drive motor;

a propeller which is driven by said drive motor, and which is disposed outwardly of said elongated body and rearwardly of said rear end;

a shell member including a front surrounding segment which surrounds and which is spaced apart from said tubular wall to define a passageway therebetween, and a rear surrounding segment which extends rearwardly from said front surrounding segment in the longitudinal direction and which terminates at a distal end that is disposed rearwardly of said propeller and that is spaced apart from said propeller in the longitudinal direction, said front surrounding segment and said distal end respectively defining a water intake port and a water outlet port which are disposed upstream and downstream of said passageway, respectively, such that water flows from said intake port and out of said outlet port through said passageway; and a pair of shoulder straps which are detachably mounted on said front surrounding segment, and a waist strap which is detachably mounted on said rear surroundings segment.

* * * * *